US010697705B2

(12) United States Patent
Yamamoto

(10) Patent No.: US 10,697,705 B2
(45) Date of Patent: Jun. 30, 2020

(54) HEAT EXCHANGER AND REFRIGERATION CYCLE APPARATUS INCLUDING THE SAME

(71) Applicant: Mitsubishi Electric Corporation, Tokyo (JP)

(72) Inventor: Kazuhide Yamamoto, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 16/099,825

(22) PCT Filed: Aug. 9, 2016

(86) PCT No.: PCT/JP2016/073435
§ 371 (c)(1),
(2) Date: Nov. 8, 2018

(87) PCT Pub. No.: WO2018/029784
PCT Pub. Date: Feb. 15, 2018

(65) Prior Publication Data

US 2019/0154341 A1 May 23, 2019

(51) Int. Cl.
*F28F 9/26* (2006.01)
*F28D 1/04* (2006.01)
(Continued)

(52) U.S. Cl.
CPC ..... *F28D 1/0417* (2013.01); *F24F 1/16* (2013.01); *F24F 13/30* (2013.01); *F25B 6/04* (2013.01);
(Continued)

(58) Field of Classification Search
CPC .... F28D 1/0417; F28D 1/0408; F28D 1/0435; F28D 1/0452; F28D 2021/007;
(Continued)

(56) References Cited

U.S. PATENT DOCUMENTS 7,331,376 B2 * 2/2008 Gagnon ..... F24F 12/006 165/54
7,875,396 B2 * 1/2011 Zhang ..... B01D 63/08 261/100
(Continued)

FOREIGN PATENT DOCUMENTS

EP 3009771 A1 4/2016
JP H09-210508 A 8/1997
(Continued)

OTHER PUBLICATIONS

International Search Report of the International Searching Authority dated Nov. 8, 2016 for the corresponding International application No. PCT/JP2016/073435 (and English translation).
(Continued)

*Primary Examiner* — Claire E Rojohn, III
(74) *Attorney, Agent, or Firm* — Posz Law Group, PLC

(57) ABSTRACT

Provided is a heat exchanger including a plurality of refrigerant flow paths each being a flow path into which refrigerant flows in a gas state and out of which the refrigerant flows in a liquid state, and including upstream-side flow paths allowing passage of the refrigerant in the gas state and a two-phase gas-liquid state, and at least one downstream-side flow path allowing passage of the refrigerant in the two-phase gas-liquid state and the liquid state. The heat exchanger further includes an upstream-side heat exchanger including the upstream-side flow paths, a downstream-side heat exchanger including the at least one downstream-side flow path, and at least one merger for merging the refrigerant flowing out of each of the upstream-side flow paths and causing the merged refrigerant to flow into the at least one downstream-side flow path. The upstream-side heat exchanger and the downstream-side heat exchanger are configured separately. The number of the downstream-side
(Continued)

flow paths is smaller than the number of the upstream-side flow paths.

8 Claims, 6 Drawing Sheets

(51) Int. Cl.

| | |
|---|---|
| ***F25B 39/04*** | (2006.01) |
| ***F25B 13/00*** | (2006.01) |
| ***F25B 6/04*** | (2006.01) |
| ***F24F 1/16*** | (2011.01) |
| ***F28F 9/02*** | (2006.01) |
| ***F24F 13/30*** | (2006.01) |
| ***F28F 1/12*** | (2006.01) |
| *F28D 21/00* | (2006.01) |

(52) U.S. Cl.
CPC ..... *F25B 13/00* (2013.01); *F25B 39/04* (2013.01); *F28D 1/0408* (2013.01); *F28D 1/0435* (2013.01); *F28D 1/0452* (2013.01); *F28F 1/12* (2013.01); *F28F 9/0275* (2013.01); *F28D 2021/007* (2013.01); *F28F 2215/04* (2013.01)

(58) Field of Classification Search
CPC ..... F24F 1/16; F24F 13/30; F25B 6/04; F25B 39/04; F28F 1/12; F28F 9/0275; F28F 2215/04
See application file for complete search history.

(56) References Cited

U.S. PATENT DOCUMENTS 8,048,585 B2 * 11/2011 Skala ..... H01M 8/04141 429/456
8,091,868 B2 * 1/2012 Robb ..... H01M 8/04126 261/101
8,235,093 B2 * 8/2012 Grinbergs ..... F24F 3/1411 165/165
8,936,668 B2 * 1/2015 Huizing ..... B01D 53/228 165/10
2009/0277621 A1 * 11/2009 Stokke ..... F28D 1/0475 165/185
2012/0118533 A1 5/2012 Jang et al.
2013/0306285 A1 * 11/2013 Jindou ..... F25B 39/00 165/173
2015/0226489 A1 * 8/2015 Higashiiue ..... F24F 1/18 165/104.19
2016/0376986 A1 * 12/2016 Ferris ..... F28F 13/06 165/173
2017/0114710 A1 * 4/2017 Santavicca ..... F02B 29/0462
2017/0115011 A1 * 4/2017 Kim ..... F24F 1/0003
2017/0268790 A1 9/2017 Yokozeki et al.

FOREIGN PATENT DOCUMENTS

| | | | |
|---|---|---|---|
| JP | 2003-021432 | A | 1/2003 |
| JP | 2009-287837 | A | 12/2009 |
| JP | 2012-077921 | A | 4/2012 |
| JP | 2012-149845 | A | 8/2012 |
| JP | 2015-117936 | A | 6/2015 |
| JP | 2016-114263 | A | 6/2016 |
| WO | 2013/190830 | A1 | 12/2013 |
| WO | 2014/199501 | A1 | 12/2014 |

OTHER PUBLICATIONS

Office Action dated Nov. 12, 2019 issued in corresponding JP patent application No. 2018-533341 (and English translation).

* cited by examiner

HEAT EXCHANGER AND REFRIGERATION CYCLE APPARATUS INCLUDING THE SAME

CROSS REFERENCE TO RELATED APPLICATION

This application is a U.S. national stage application of PCT/JP2016/07345 filed on Aug. 9, 2016, the contents of which are incorporated herein by reference.

TECHNICAL FIELD

The present invention relates to a heat exchanger operating as a condenser and to a refrigeration cycle apparatus including the heat exchanger.

BACKGROUND ART

In a related-art refrigeration cycle apparatus, a refrigeration cycle circuit is formed by sequentially connecting a compressor, a condenser, a pressure-reducing device, and an evaporator by refrigerant pipes. As the condenser used in the refrigeration cycle apparatus, there is known a condenser having a plurality of refrigerant flow paths connected in parallel (see, for example, Patent Literature 1). In Patent Literature 1, there is disclosed a technique for setting height positions of refrigerant outlets of a plurality of refrigerant flow paths to suppress drift current in the plurality of refrigerant flow paths.

CITATION LIST

Patent Literature

Patent Literature 1: Japanese Unexamined Patent Application Publication No. 2009-287837

SUMMARY OF INVENTION

Technical Problem

When a heat exchanger operates as a condenser, refrigerant passing through a plurality of heat transfer tubes changes its phase from gas to liquid by exchanging heat with air passing through a large number of radiator fins. Inside the heat transfer tubes, there exists a state of mixing a gas single-phase region, a two-phase region, and a subcooled liquid region. In the gas single-phase region, heat is exchanged to gradually decrease the refrigerant temperature, and there only exists gas. In the two-phase region, the refrigerant temperature is substantially constant even though the heat exchange is performed, and gas and liquid are mixed. In the region of the subcooled liquid, the temperature of the liquid refrigerant is gradually decreased to the temperature of air passing through the heat exchanger by exchanging heat even after liquefying, and there only exists liquid.

As described above, the heat transfer tubes include three regions of different temperatures. Therefore, in the condenser, there are formed a high-temperature section and a low-temperature section. The high-temperature section is formed of a heat transfer tube portion of the gas single-phase region and the two-phase region and radiator fins, which allow passage of the heat transfer tube portion. The low-temperature section is formed of a heat transfer tube portion of the subcooled liquid region and radiator fins, which allow passage of the heat transfer tube portion.

In Patent Literature 1, in the heat exchanger operating as a condenser, the high-temperature section and the low-temperature section are mixed and provided integrally. Therefore, there has been a problem in that heat of the high-temperature section is leaked to the low-temperature section, so that temperature efficiency in the heat exchanger decreases.

The present invention has been made to solve the above-mentioned problem, and has an object to provide a heat exchanger capable of, when operating as a condenser, reducing heat leakage in the condenser, and a refrigeration cycle apparatus including the heat exchanger.

Solution to Problem

A heat exchanger according to one embodiment of the present invention includes a plurality of refrigerant flow paths each being a flow path into which refrigerant flows in a gas state and out of which the refrigerant flows in a liquid state, and including upstream-side flow paths allowing passage of the refrigerant in the gas state and a two-phase gas-liquid state, and at least one downstream-side flow path allowing passage of the refrigerant in the two-phase gas-liquid state and the liquid state. The heat exchanger further includes an upstream-side heat exchanger including the upstream-side flow paths, a downstream-side heat exchanger including the at least one downstream-side flow path, and at least one merger for merging the refrigerant flowing out of each of the upstream-side flow paths and causing the merged refrigerant to flow into the at least one downstream-side flow path. The upstream-side heat exchanger and the downstream-side heat exchanger are configured separately. The number of the downstream-side flow paths is smaller than the number of the upstream-side flow paths.

A refrigeration cycle apparatus according to one embodiment of the present invention includes the heat exchanger.

Advantageous Effects of Invention

According to one embodiment of the present invention, it is possible to reduce heat leakage in a heat exchanger when the heat exchanger operates as a condenser.

DESCRIPTION OF EMBODIMENTS

Figure 1:
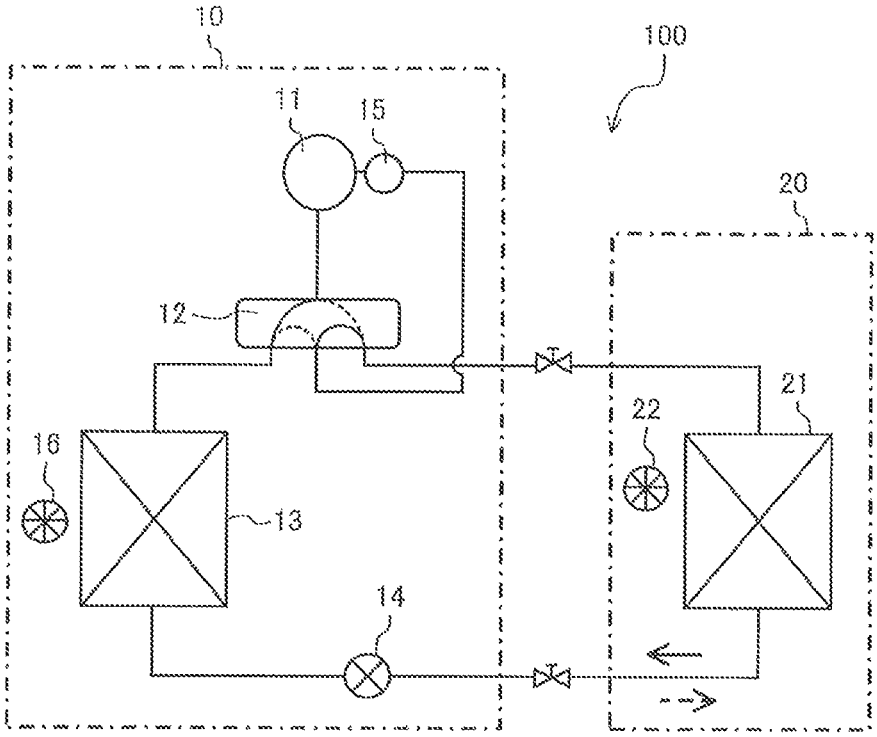
FIG. 1 is a configuration diagram of an air-conditioning apparatus including a heat exchanger according to Embodiment 1 of the present invention.

With reference to drawings, description is made below of an air-conditioning apparatus, which is an example of a refrigeration cycle apparatus including a heat exchanger. The present invention is not limited to the embodiments described later. Moreover, portions denoted by the same reference signs in the drawings are the same or corresponding portions, and this is common in all of the sentences in Description. Further, forms of components represented throughout Description are mere examples, and the present invention is not limited to these descriptions.

Embodiment 1

FIG. 1 is a configuration diagram of an air-conditioning apparatus including a heat exchanger according to Embodiment 1 of the present invention. In FIG. 1, the solid arrow indicates a flow direction of refrigerant during a heating operation, and the broken arrow indicates a flow direction of refrigerant during a cooling operation.

As illustrated in FIG. 1, an air-conditioning apparatus 100 including a heat exchanger according to Embodiment 1 includes an outdoor unit 10 and an indoor unit 20.

The outdoor unit 10 includes a compressor 11 configured to compress refrigerant, a four-way valve 12, an outdoor-side heat exchanger 13, a pressure-reducing device 14, an accumulator 15, and an outdoor-side air-sending device 16.

The compressor 11 is configured to suck refrigerant and compress the refrigerant to bring the refrigerant into a high-temperature and high-pressure state. The compressor 11 may be a compressor capable of varying an operation capacity (frequency) or a compressor having a specified capacity. The four-way valve 12 is configured to switch a circulation direction of refrigerant between the cooling operation and the heating operation. The outdoor-side heat exchanger 13 is formed of a fin-and-tube heat exchanger. The details of the configuration of the outdoor-side heat exchanger 13 are described later.

The pressure-reducing device 14 is configured to reduce pressure of high-pressure liquid refrigerant to form the refrigerant into low-pressure two-phase gas-liquid refrigerant, and is formed of, for example, an expansion valve. The accumulator 15 is configured to separate the liquid refrigerant and the gas refrigerant, and to supply the gas refrigerant to the compressor 11. The outdoor-side air-sending device 16 is a fan configured to send air to an indoor-side heat exchanger 21, and is formed of a centrifugal fan, a multi-blade fan, or other fan.

The indoor unit 20 includes the indoor-side heat exchanger 21 and an indoor-side air-sending device 22. The indoor-side heat exchanger 21 is formed of a fin-and-tube heat exchanger. The indoor-side air-sending device 22 is a fan configured to send air to the indoor-side heat exchanger 21, and is formed of, for example, a cross flow fan, a propeller fan, or other fan.

In the air-conditioning apparatus 100, a refrigeration cycle circuit is formed by sequentially connecting the compressor 11, the four-way valve 12, the outdoor-side heat exchanger 13, the pressure-reducing device 14, the indoor-side heat exchanger 21 and the accumulator 15 by pipes.

It is possible to switch between the cooling operation and the heating operation by switching the four-way valve 12. The refrigeration cycle circuit of the air-conditioning apparatus 100 during the cooling operation is formed by circularly connecting the compressor 11, the outdoor-side heat exchanger 13 operating as a condenser, the pressure-reducing device 14, the indoor-side heat exchanger 21 operating as an evaporator, and the accumulator 15 by refrigerant pipes. Moreover, the refrigeration cycle circuit of the air-conditioning apparatus 100 during the heating operation is formed by circularly connecting the compressor 11, the indoor-side heat exchanger 21 operating as a condenser, the pressure-reducing device 14, the outdoor-side heat exchanger 13 operating as an evaporator and the accumulator 15 by refrigerant pipes.

The air-conditioning apparatus 100 configured as described above operates as follows.

During the cooling operation, the refrigerant compressed by the compressor 11 and brought into a high-temperature and high-pressure gas state flows into the outdoor-side heat exchanger 13 via the four-way valve 12. The refrigerant flowing into the outdoor-side heat exchanger 13 exchanges heat with an outdoor air from the outdoor-side air-sending device 16 and radiates condensation latent heat to be brought into a high-pressure liquid state.

The liquid refrigerant flowing out of the outdoor-side heat exchanger 13 passes through the pressure-reducing device 14 to be reduced in pressure to form the low-pressure two-phase gas-liquid refrigerant, and flows into the indoor-side heat exchanger 21. The refrigerant flowing into the indoor-side heat exchanger 21 exchanges heat with an indoor air from the indoor-side air-sending device 22, and absorbs heat in the form of evaporation latent heat from the indoor air to be evaporated. Then, the refrigerant evaporated and brought into the gas state flows out of the indoor-side heat exchanger 21, and returns to the compressor 11 via the four-way valve 12 and the accumulator 15. The cooling operation is performed by circulation of refrigerant in the refrigeration cycle circuit as described above.

The outdoor-side heat exchanger 13 operates as a condenser in the above-mentioned refrigeration cycle circuit, and the refrigerant in the gas state flows into the outdoor-side heat exchanger 13 and flows out in the liquid state. The outdoor-side heat exchanger 13 operating as a condenser is described below in detail.

Figure 2:
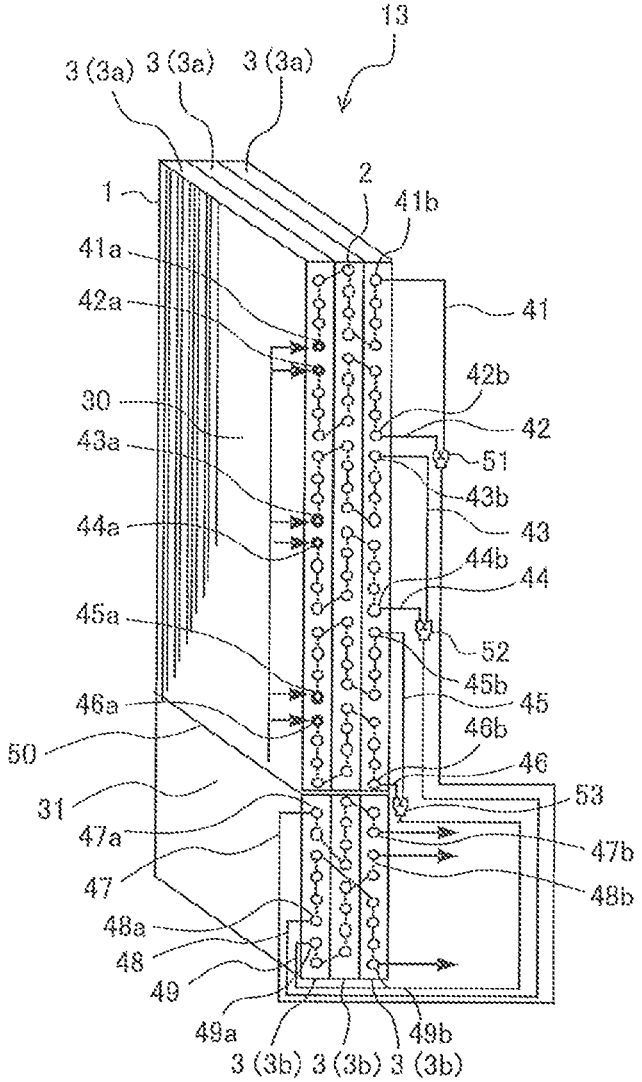
FIG. 2 is a schematic perspective view of an outdoor-side heat exchanger 13 according to Embodiment 1 of the present invention.

FIG. 2 is a schematic perspective view of the outdoor-side heat exchanger 13 according to Embodiment 1 of the present invention.

The outdoor-side heat exchanger 13 includes an upstream-side heat exchanger 30 and a downstream-side heat exchanger 31 that are configured separately.

The upstream-side heat exchanger 30 and the downstream-side heat exchanger 31 each have a configuration in which three heat exchange units 3 are arrayed in an air passage direction. The heat exchange units 3 each include a plurality of radiator fins 1 and a plurality of heat transfer tubes 2. The plurality of radiator fins 1 are arranged in parallel at intervals, and allow passage of air through the intervals. The plurality of heat transfer tubes 2 penetrate through the plurality of radiator fins 1 in an arrangement direction of the plurality of radiator fins 1. In the following description, in some cases, the heat exchange units 3 are distinguished as upstream-side heat exchange units 3*a* on the upstream-side heat exchanger 30 side and downstream-side heat exchange units 3*b* on the downstream-side heat exchanger 31 side.

Figure 3:
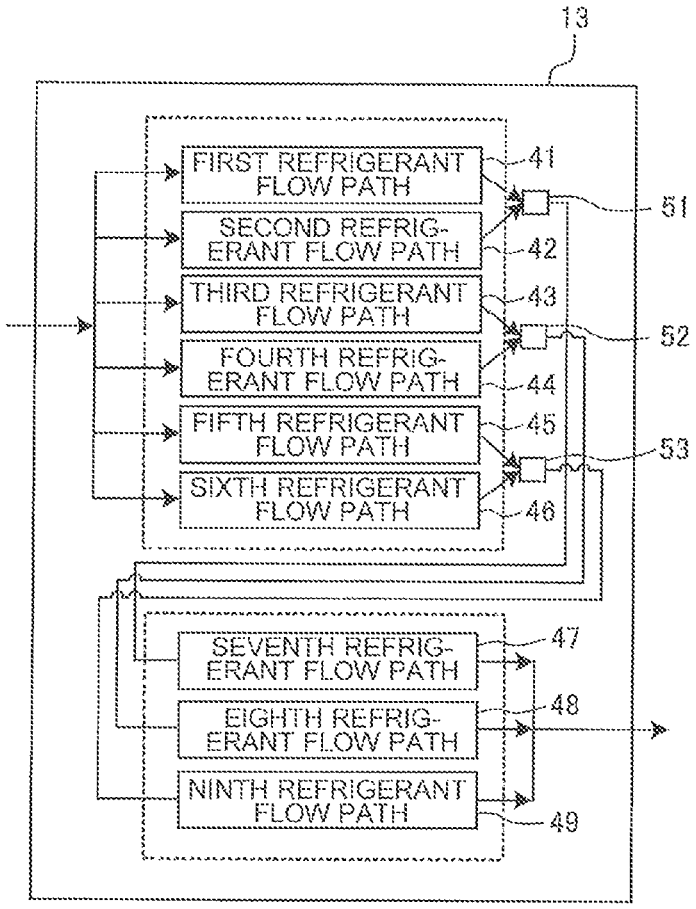
FIG. 3 is an explanatory view for illustrating refrigerant flow paths in the outdoor-side heat exchanger 13 according to Embodiment 1 of the present invention.

FIG. 3 is an explanatory view for illustrating refrigerant flow paths in the outdoor-side heat exchanger 13 according to Embodiment 1 of the present invention.

The outdoor-side heat exchanger 13 includes a first refrigerant flow path 41 to a ninth refrigerant flow path 49. The first refrigerant flow path 41 to the sixth refrigerant flow path 46, which are the upstream half of the refrigerant flow paths from a refrigerant inlet to a refrigerant outlet of the outdoor-side heat exchanger 13 and allow passage of the refrigerant in the gas state and the two-phase gas-liquid state, are provided to the upstream-side heat exchanger 30. Moreover, the seventh refrigerant flow path 47 to the ninth refrigerant flow path 49, which are the downstream half of the refrigerant flow paths from the refrigerant inlet to the refrigerant outlet of the outdoor-side heat exchanger 13 and allow passage of the refrigerant in the two-phase gas-liquid state and the liquid state, are provided to the downstream-side heat exchanger 31.

The first refrigerant flow path 41 to the sixth refrigerant flow path 46 are connected in parallel with each other, and the seventh refrigerant flow path 47 to the ninth refrigerant flow path 49 are connected in parallel with each other downstream of the first refrigerant flow path 41 to the sixth refrigerant flow path 46. The first refrigerant flow path 41 to the sixth refrigerant flow path 46 form upstream-side flow paths of the present invention, and the seventh refrigerant flow path 47 to the ninth refrigerant flow path 49 each form a downstream-side flow path of the present invention.

In the outdoor-side heat exchanger 13 operating as a condenser, as described above, the refrigerant flows into the outdoor-side heat exchanger 13 in the high-temperature gas state, and flows out in the low-temperature liquid state. With regard to the refrigerant temperature, the inequality of gas refrigerant> two-phase refrigerant> liquid refrigerant is satisfied. Therefore, the upstream-side heat exchanger 30 serves as the high-temperature section, and the downstream-side heat exchanger 31 serves as the low-temperature section. When the upstream-side heat exchanger 30 and the downstream-side heat exchanger 31 are integrally formed, heat is leaked from the high-temperature section to the low-temperature section. However, in Embodiment 1, the upstream-side heat exchanger 30 and the downstream-side heat exchanger 31 are formed separately, and hence heat leakage can be reduced. As a result, it is possible to increase the heat exchange efficiency in the outdoor-side heat exchanger 13. Moreover, heat is likely to be transferred upward, and hence the upstream-side heat exchanger 30 is arranged above the downstream-side heat exchanger 31.

Moreover, when the refrigerant is in the liquid state, the heat exchange efficiency can be increased by increasing the flow rate of refrigerant passing through the heat transfer tubes 2. For this reason, the number of the downstream-side flow paths (here, three) is set smaller than the number of the upstream-side flow paths (here, six).

With reference to FIG. 2, the configuration of the outdoor-side heat exchanger 13 is described below more specifically.

The first refrigerant flow path 41 is formed of a flow path reaching a merger 51 from an inlet portion 41*a* via an outlet portion 41*b*. The second refrigerant flow path 42 is formed of a flow path reaching the merger 51 from an inlet portion 42*a* via an outlet portion 42*b*. The third refrigerant flow path 43 is formed of a flow path reaching a merger 52 from an inlet portion 43*a* via an outlet portion 43*b*. The fourth refrigerant flow path 44 is formed of a flow path reaching the merger 52 from an inlet portion 44*a* via an outlet portion 44*b*. The fifth refrigerant flow path 45 is formed of a flow path reaching a merger 53 from an inlet portion 45*a* via an outlet portion 45*b*. The sixth refrigerant flow path 46 is formed of a flow path reaching the merger 53 from an inlet portion 46*a* via an outlet portion 46*b*.

The seventh refrigerant flow path 47 is formed of a flow path reaching an outlet portion 47*b* from the merger 51 via an inlet portion 47*a*. The eighth refrigerant flow path 48 is formed of a flow path reaching an outlet portion 48*b* from the merger 52 via an inlet portion 48*a*. The ninth refrigerant flow path 49 is formed of a flow path reaching an outlet portion 49*b* from the merger 53 via an inlet portion 49*a*.

The total number of heat transfer tubes 2 forming the seventh refrigerant flow path 47 to the ninth refrigerant flow path 49 is smaller than the total number of heat transfer tubes 2 forming the first refrigerant flow path 41 to the sixth refrigerant flow path 46. In other words, the number of heat transfer tubes 2 in the downstream-side heat exchanger 31 is smaller than the number of heat transfer tubes 2 in the upstream-side heat exchanger 30. One of the reasons therefor is as follows.

That is, refrigerant is in a liquid state at an outlet of a condenser, and hence refrigerant is liable to be accumulated in general. Consequently, when the refrigerant is accumulated in the condenser without being circulated, an air-conditioning apparatus is operated with "residual refrigerant amount", which is a result of excluding the accumulated amount of liquid refrigerant. For this reason, it is necessary to increase the refrigerant amount and to fill the refrigeration cycle circuit with the refrigerant in anticipation of accumulation of the liquid refrigerant. From another perspective, when the accumulation amount of liquid refrigerant at the outlet of the condenser can be reduced, it is possible to reduce the refrigerant amount to be filled.

When a flow path through which liquid refrigerant flows is long in a condenser, in other words, when the number of heat transfer tubes 2 through which the liquid refrigerant flows is large, a spatial volume that allows accumulation of refrigerant is also increased accordingly, and the accumulation amount is increased as well. From the above, the number of heat transfer tubes 2 in the downstream-side heat exchanger 31 is smaller than the number of heat transfer tubes 2 in the upstream-side heat exchanger 30.

Moreover, a facing surface 50 of the upstream-side heat exchanger 30 and a facing surface 50 of the downstream-side heat exchanger 31 facing each other each are herein a flat surface extending in the air passage direction. When it is assumed that the facing surfaces 50 each are in an inclined state or a stepped state of being inclined upward as approaching toward the air passage direction, the air having passed through the upstream-side heat exchanger 30 side and raised in temperature passes through the downstream-side heat exchanger 31 side. However, in Embodiment 1, the facing surfaces 50 each are assumed to be a flat surface extending in the air passage direction, and the air having passed through the upstream-side heat exchanger 30 side does not pass through the downstream-side heat exchanger 31 side, to thereby avoid inconvenience of causing decrease in heat exchanger efficiency. To obtain the above-mentioned effect, it is preferred that the facing surfaces 50 each be a flat surface extending in the air passage direction. However, the present invention is not limited to the preferred example, and includes the mode of the stepped state or the inclined state.

Next, with reference to FIGS. 1 to 3, description is made of flow of refrigerant in the outdoor-side heat exchanger 13 during the cooling operation.

During the cooling operation, the refrigerant flowing into a housing (not shown) of the outdoor-side heat exchanger 13 is branched into six. Each part of the refrigerant branched into six first passes through the upstream-side heat exchanger 30. In other words, parts of the refrigerant pass through the first refrigerant flow path 41, the second refrigerant flow path 42, the third refrigerant flow path 43, the fourth refrigerant flow path 44, the fifth refrigerant flow path 45, and the sixth refrigerant flow path 46. At this time, each refrigerant changes from the gas refrigerant into the two-phase refrigerant by exchanging heat with air passing through the radiator fins 1 of the outdoor-side heat exchanger 13.

The parts of the refrigerant having passed through the first refrigerant flow path 41, the second refrigerant flow path 42, the third refrigerant flow path 43, the fourth refrigerant flow path 44, the fifth refrigerant flow path 45, and the sixth refrigerant flow path 46 merge in the mergers 51 to 53 by two flow paths. Then, after merging, the parts of the refrigerant pass through the seventh refrigerant flow path 47, the eighth refrigerant flow path 48, and the ninth refrigerant flow path 49. At this time, each refrigerant changes from the two-phase refrigerant into the liquid refrigerant by exchanging heat with air passing through the radiator fins 1 of the downstream-side heat exchanger 31. Then, the parts of the refrigerant flow out through the outlet portions 47*b*, 48*b*, and 49*b* while further changing from the liquid refrigerant into the subcooled-liquid refrigerant. After that, the parts of the refrigerant merge together to flow out of the housing (not shown) of the outdoor-side heat exchanger.

As described above, the refrigerant passing through the upstream-side heat exchanger 30 flows in as the gas refrigerant and flows out as the two-phase refrigerant. On the other hand, the refrigerant passing through the downstream-side heat exchanger flows in as the two-phase refrigerant and flows out as the subcooled-liquid refrigerant. Consequently, although the temperature of the upstream-side heat exchanger 30 is higher than the temperature of the downstream-side heat exchanger 31, heat leakage from the upstream-side heat exchanger 30 to the downstream-side heat exchanger can be suppressed because the upstream-side heat exchanger 30 and the downstream-side heat exchanger 31 are configured separately.

As described above, in Embodiment 1, the outdoor-side heat exchanger 13 serving as a condenser is provided with the upstream-side heat exchanger 30 including the upstream-side flow paths, which allow passage of the refrigerant in the gas state and the two-phase gas-liquid state and the downstream-side heat exchanger 31 including the downstream-side flow paths, which allow passage of the refrigerant in the two-phase gas-liquid state and the liquid state, and the upstream-side heat exchanger 30 and the downstream-side heat exchanger 31 are configured separately. In other words, with the separate configuration of the upstream-side heat exchanger 30 being the high-temperature section and the downstream-side heat exchanger 31 being the low-temperature section, heat leakage from the high-temperature section to the low-temperature section can be reduced, and it is possible to improve capability, as compared to a case of integrated configuration.

Moreover, the mergers 51 to 53 for merging the parts of the refrigerant having flowed out of the first refrigerant flow path 41 to the sixth refrigerant flow path 46 and causing the parts of the refrigerant to flow into the seventh refrigerant flow path 47 to the ninth refrigerant flow path 49 are provided, to thereby set the number of downstream-side flow paths to be smaller than the number the upstream-side flow paths. In other words, the number of refrigerant flow paths allowing passage of the liquid refrigerant is reduced to increase the flow rate of the refrigerant passing through a single refrigerant flow path. Therefore, it is possible to increase the heat exchange efficiency as compared to a case in which the number of flow paths is the same between the upstream-side flow paths and the downstream-side flow paths.

Moreover, the upstream-side heat exchanger 30 is arranged above the downstream-side heat exchanger 31. Therefore, it is possible to suppress transfer of heat of the upstream-side heat exchanger 30 to the downstream-side heat exchanger 31 as compared to a case of arranging upside down.

Moreover, as the number of heat transfer tubes 2 in the downstream-side heat exchanger 31 becomes larger, the liquid refrigerant flowing through the downstream-side heat exchanger 31 is increased, so that the amount of liquid refrigerant accumulated in the heat transfer tubes 2 is increased. Here, the number of heat transfer tubes 2 in the downstream-side heat exchanger 31 is set smaller than that of the upstream-side heat exchanger 30 to reduce the number of heat transfer tubes 2 in the downstream-side heat exchanger 31. Therefore, the amount of liquid refrigerant accumulated in the heat transfer tubes 2 can be reduced as compared to the case of the same number of heat transfer tubes 2, and as a result, the refrigerant amount to be filled can be reduced.

Moreover, the facing surface 50 of the upstream-side heat exchanger 30 and the facing surface 50 of the downstream-side heat exchanger 31 facing each other each are a flat surface extending in the air passage direction. Therefore, the air having passed through the upstream-side heat exchanger 30 side does not pass through the downstream-side heat exchanger side, to thereby avoid inconvenience of causing decrease in heat exchanger efficiency.

In Embodiment 1, the heat exchanger illustrated in FIG. 2 is a mere example, and the number of heat exchange units 3 may be other than three as long as a plurality of heat exchange units 3 are arrayed in the air passage direction.

Moreover, in Embodiment 1, the number of flow paths in the upstream-side heat exchanger 30 is six, and the number of flow paths in the downstream-side heat exchanger is three. However, the present invention is not limited to this configuration.

Moreover, in Embodiment 1, the number of flow paths in the upstream-side heat exchanger 30 is set larger than the number of flow paths in the downstream-side heat exchanger 31. This is because, as described above, when the refrigerant is in the liquid state, the heat exchange efficiency can be increased by increasing the flow rate of refrigerant passing through the heat transfer tubes 2. However, the present invention is not limited to the configuration in which the number of flow paths in the upstream-side heat exchanger 30 is set larger than the number of flow paths in the downstream-side heat exchanger, and the number of flow paths may be the same.

Embodiment 2

In Embodiment 1 described above, the number of the heat exchange units 3 is the same between the upstream-side heat exchanger 30 and the downstream-side heat exchanger 31. However, in Embodiment 2, the number of the heat exchange units 3 of the downstream-side heat exchanger 31 is set smaller than that of the upstream-side heat exchanger 30 to reduce the number of heat transfer tubes 2 through which the liquid refrigerant passes. Description is made below by focusing on components of Embodiment 2 different from Embodiment 1. Components not described in Embodiment 2 are the same as those of Embodiment 1.

Figure 4:
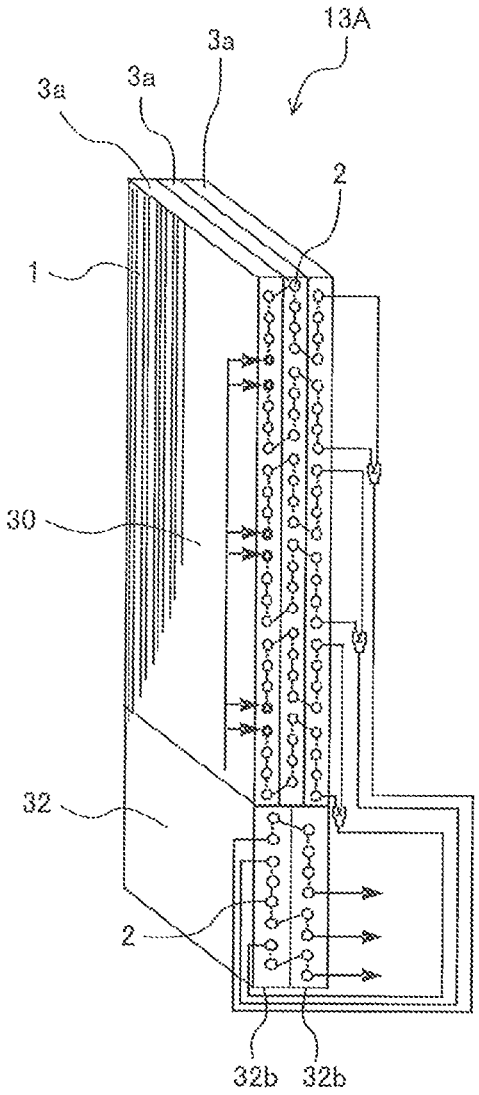
FIG. 4 is a schematic perspective view of an outdoor-side heat exchanger 13A according to Embodiment 2 of the present invention.

FIG. 4 is a schematic perspective view for illustrating an outdoor-side heat exchanger 13A according to Embodiment 2 of the present invention.

The outdoor-side heat exchanger 13A in Embodiment 2 is different only in the components of the downstream-side heat exchanger as compared to the outdoor-side heat exchanger 13 in Embodiment 1 illustrated in FIG. 2. The other components are the same as those of the outdoor-side heat exchanger 13 in Embodiment 1. The downstream-side heat exchanger 32 in Embodiment 2 is configured with two heat exchange units. The number of heat transfer tubes 2 in a single downstream-side heat exchange unit 32*b* is the same as that of the downstream-side heat exchange unit 3*b* in Embodiment 1, and is set to eight in this example. The number of heat transfer tubes 2 in the downstream-side heat exchange unit 32*b* is not limited to eight.

Figure 5:
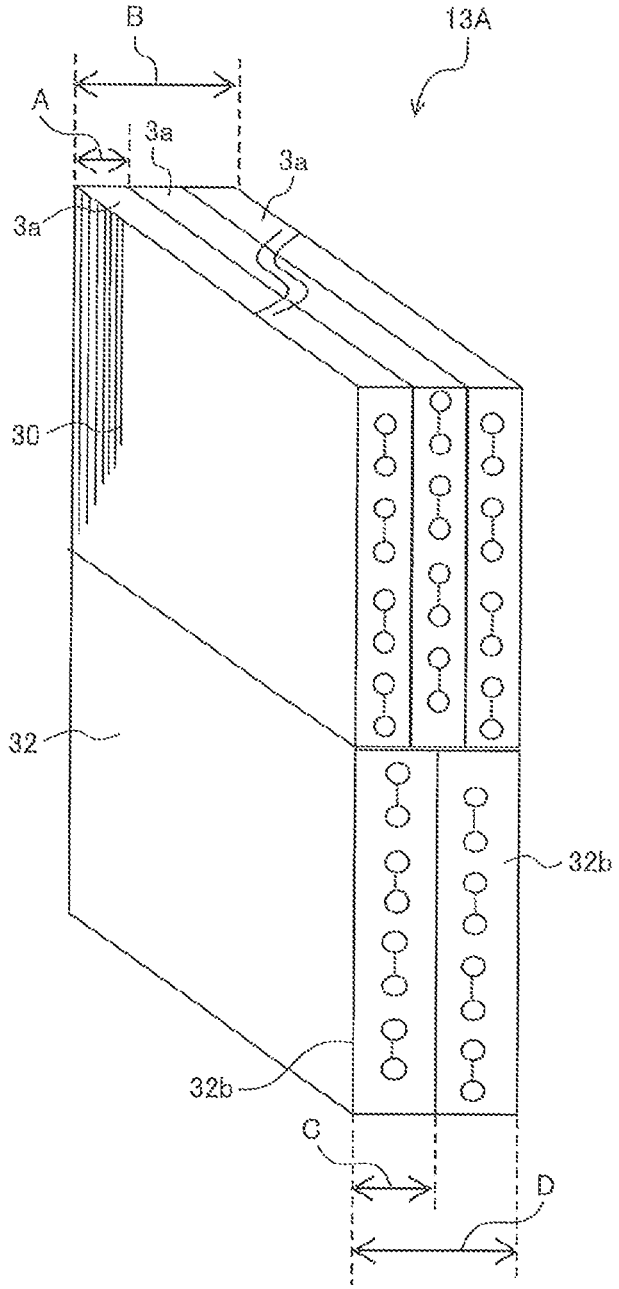
FIG. 5 is an explanatory view for illustrating dimension of the outdoor-side heat exchanger 13A according to Embodiment 2 of the present invention.

FIG. 5 is an explanatory view for illustrating dimension of the outdoor-side heat exchanger 13A according to Embodiment 2 of the present invention. In the outdoor-side heat exchanger 13A in Embodiment 2, the upstream-side heat exchanger 30 and the downstream-side heat exchanger 32 are configured based on the following dimensional relationship.

$$A<C$$

$$B=D$$

where

A: a width of the upstream-side heat exchange unit 3*a* in the air passage direction B: a total width of all of the upstream-side heat exchange units 3*a* in the air passage direction C: a width of the downstream-side heat exchange unit 32*b* in the air passage direction D: a total width of all of the downstream-side heat exchange units 32*b* in the air passage direction In other words, the width of the entire radiator fins 1 of all of the three heat exchange units of the upstream-side heat exchanger 30 in the air passage direction is set to the same dimension as the width of the entire radiator fins 1 of all of the two heat exchange units of the downstream-side heat exchanger 32 in the air passage direction.

In the outdoor-side heat exchanger 13A having the above-mentioned configuration, in the upstream-side heat exchanger 30, similarly to Embodiment 1, the refrigerant becomes the two-phase refrigerant and flows out while facilitating heat exchange with air. In the downstream-side heat exchanger 32, the two-phase refrigerant comes in and changes into the liquid refrigerant by exchanging heat with air, and then further changes into the subcooled-liquid refrigerant. Then, through reduction of the number of heat transfer tubes 2 of the downstream-side heat exchanger 32, the flow path from changing into the subcooled-liquid refrigerant to the outlet of the downstream-side heat exchanger 32 becomes shorter. In other words, the accumulation amount of refrigerant is reduced by the internal cubic volume of the shortened flow path of the heat transfer tubes 2.

As described above, according to Embodiment 2, as well as obtaining the same effects as Embodiment 1, the following effect can further be obtained. That is, with the configuration in which the number of heat exchange units 3 of the downstream-side heat exchanger 31 is set smaller than that of the upstream-side heat exchanger 30, it is possible to reduce the number of heat transfer tubes 2 through which the subcooled-liquid refrigerant flows. Consequently, the accumulation amount of liquid refrigerant can be reduced by the internal cubic volume of the reduced number of heat transfer tubes 2. As a result, it becomes unnecessary to fill the refrigerant to the amount in anticipation of the accumulation amount, and it is possible to provide the heat exchanger capable of reducing the refrigerant amount to be included in the refrigeration cycle apparatus.

Moreover, as the width of the entire radiator fins 1 of all of the three heat exchange units of the upstream-side heat exchanger 30 in the air passage direction is set to the same dimension as the width of the entire radiator fins 1 of all of the two heat exchange units of the downstream-side heat exchanger 32 in the air passage direction, the following effect can be obtained. In other words, when the width of the radiator fins 1 of the heat exchange units 3 in the air passage direction is the same between the upstream-side heat exchanger 30 and the downstream-side heat exchanger 32, and the width of the entire radiator fins 1 of all of the heat exchange units of the downstream-side heat exchanger 32 in the air passage direction is shorter than that of the upstream-side heat exchanger 30, the heat exchange efficiency is decreased by the shortened width of the radiator fins. However, the width of the entire radiator fins 1 of all of the heat exchange units in the air passage direction is set the same between the downstream-side heat exchanger 32 and the upstream-side heat exchanger 30, to thereby avoid the decrease in heat exchange efficiency.

Moreover, the widths of the radiator fins 1 in the air passage direction are the same with each other among the heat exchange units 3 of the downstream-side heat exchanger 32, and hence the heat exchange efficiency of the heat exchange units 3 is not biased to one side, but can be the same.

Embodiment 3

In Embodiment 1 and Embodiment 2 described above, a fin pitch, which is a width between the radiator fins, is the same between the upstream-side heat exchanger and the downstream-side heat exchanger. However, in Embodiment 3, the fin pitch of the downstream-side heat exchanger is set smaller than that of the upstream-side heat exchanger. Description is made below by focusing on portions of Embodiment 3 different from Embodiment 2. Components not described in Embodiment 3 are the same as those of Embodiment 2.

Figure 6:
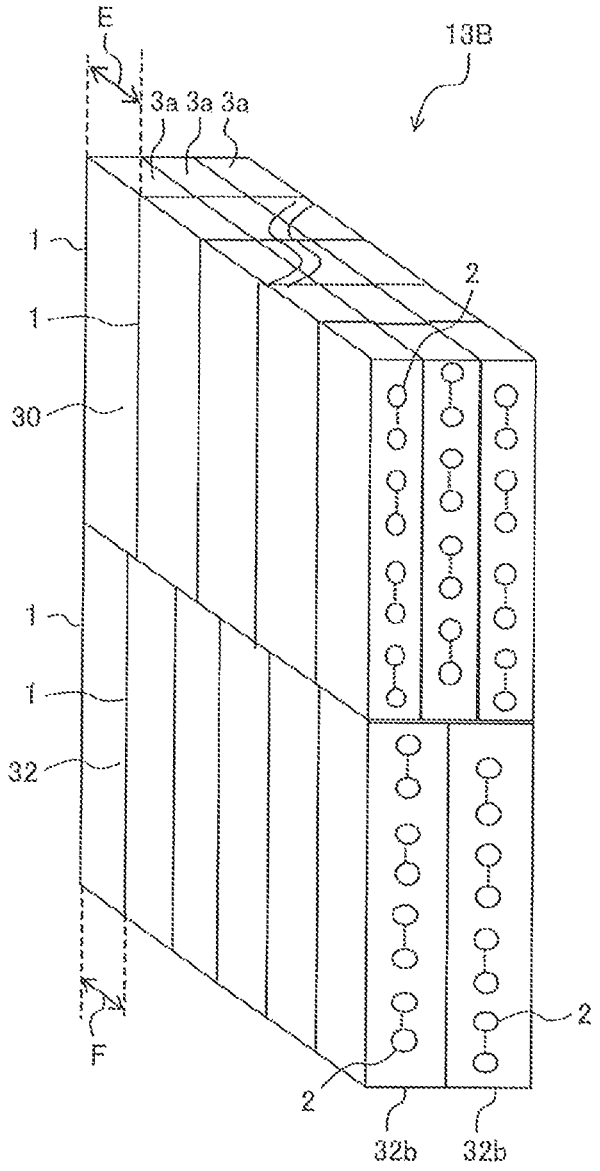
FIG. 6 is an explanatory view for illustrating dimension of an outdoor-side heat exchanger 13B according to Embodiment 3 of the present invention.

FIG. 6 is an explanatory view for illustrating dimension of the outdoor-side heat exchanger 13B according to Embodiment 3 of the present invention. In FIG. 6, for the sake of convenience in description, intervals between the adjacent radiator fins 1 are enlarged to be illustrated.

In the outdoor-side heat exchanger 13B of Embodiment 3, when the fin pitch of the radiator fins 1 of the upstream-side heat exchange unit 3*a* is represented by E, and the fin pitch of the radiator fins 1 of the downstream-side heat exchange unit 32*b* is represented by F, the inequality of E>F is satisfied.

In Embodiment 2 described above, it is conceivable that sufficient heat exchange performance cannot be obtained on the downstream-side heat exchanger 32 side due to reduction of the number of heat transfer tubes 2 of the downstream-side heat exchanger 32 through which the subcooled-liquid refrigerant flows. As a measure against this conceivability, the fin pitch F on the downstream-side heat exchanger 32 side is set smaller than the fin pitch E on the upstream-side heat exchanger 30 side.

As described above, according to Embodiment 3, as well as obtaining the same effects as Embodiment 2, the following effect can be obtained by setting the inequality of E>F. That is, it is possible to increase the heat exchange performance of the downstream-side heat exchanger 32 as compared to a case in which the fin pitch F on the downstream-side heat exchanger 32 side is the same as the fin pitch E on the upstream-side heat exchanger 30 side. Consequently, it is possible to cover the decrease in heat exchange performance caused by reducing the number of heat transfer tubes 2 of the downstream-side heat exchanger 32 through which the subcooled-liquid refrigerant flows.

In Embodiments 1 to 3 described above, description is made by using the air-conditioning apparatus as an example of the refrigeration cycle apparatus, but in recent years, in the air-conditioning apparatus, the refrigerant to be included in the refrigeration cycle circuit has been changed from the viewpoint of prevention of global warming. R410A, which is an HFC refrigerant, has been used, but the refrigerants are being changed to those having lower GWP (global warming potential). As a type of such low-GWP refrigerants, there is halogen hydrocarbon including a carbon double bond in its composition. Representatives of the low-GWP refrigerants include HFO-1234yf ($CF_3CF{=}CH_2$), HFO-1234ze ($CF_3{-}CH{=}CHF$), and HFO-1123 ($CF_2{=}CHF$).

Although these refrigerants are a type of the HFC refrigerants, as unsaturated hydrocarbon including carbon double bond is referred to as olefin, these refrigerants often represented as HFO using "O" of olefin. Such HFO refrigerants are to be used as refrigerants to be mixed with R32, which is the HFC refrigerant. However, such mixed refrigerants are different from R410 that is non-flammable, and have flammability on a level of slight heat.

Moreover, similarly as the low-GWP refrigerants, use of HC refrigerants typified by R290 ($C_3H_8$) is also considered, but these refrigerants also have flammability. In using such flammable refrigerants, to prevent ignition of leaked refrigerant even when any refrigerant is leaked in a room, measures for preventing formation of a gas phase of flammability concentration in the room are required. Also, as the leaked refrigerant amount is smaller, the gas phase of the flammability concentration is less liable to be formed.

As described so far, with any of Embodiments 1 to 3 to which the present invention is applied, it is possible to reduce the refrigerant amount to be included in the refrigeration cycle circuit as compared to a refrigeration cycle apparatus to which the present invention is not applied. Therefore, even when any refrigerant is leaked, the amount of the leaked refrigerant can be reduced. Thus, the heat exchanger according to the present invention is particularly suitable to a refrigeration cycle apparatus using refrigerants having flammability.

In Embodiments 1 to 3 described above, description is made by taking the outdoor-side heat exchanger 13 as an example of the heat exchanger. However, the present invention can also be applied to the indoor-side heat exchanger 21.

Moreover, in Embodiments 1 to 3 described above, description is made on the assumption that the refrigeration cycle apparatus is the air-conditioning apparatus. However, the refrigeration cycle apparatus may be a cooling device for cooling a refrigerated warehouse or others.

REFERENCE SIGNS LIST

1 radiator fin 2 heat transfer tube 3 heat exchange unit 3*a* upstream-side heat exchange unit 3*b* downstream-side heat exchange unit 10 outdoor unit 11 compressor 12 four-way valve 13 outdoor-side heat exchanger 13A outdoor-side heat exchanger 13B outdoor-side heat exchanger 14 pressure-reducing device 15 accumulator 16 outdoor-side air-sending device 20 indoor unit 21 indoor-side heat exchanger 22 indoor-side air-sending device 30 upstream-side heat exchanger 31 downstream-side heat exchanger 32 downstream-side heat exchanger 32*b* downstream-side heat exchange unit 41 first refrigerant flow path 41*a* inlet portion 41*b* outlet portion 42 second refrigerant flow path 42*a* inlet portion 42*b* outlet portion 43 third refrigerant flow path 43*a* inlet portion

43*b* outlet portion 44 fourth refrigerant flow path 44*a* inlet portion 44*b* outlet portion 45 fifth refrigerant flow path 45*a* inlet portion 45*b* outlet portion 46 sixth refrigerant flow path 46*a* inlet portion 46*b* outlet portion 47 seventh refrigerant flow path 47*a* inlet portion 47*b* outlet portion 48 eighth refrigerant flow path 48*a* inlet portion 48*b* outlet portion 49 ninth refrigerant flow path 49*a* inlet portion 49*b* outlet portion 50 facing surface 51 merger 52 merger 53 merger 100 air-conditioning apparatus E fin pitch F fin pitch

The invention claimed is:

1. A heat exchanger, comprising:

a plurality of refrigerant flow paths, wherein each flow path is a flow path into which refrigerant flows in a gas state and out of which the refrigerant flows in a liquid state, and the plurality of refrigerant flow paths includes upstream-side flow paths, which allow passage of the refrigerant in the gas state and a two-phase gas-liquid state, and at least one downstream-side flow path, which allows passage of the refrigerant in the two-phase gas-liquid state and the liquid state;

an upstream-side heat exchanger, which includes the upstream-side flow paths;

a downstream-side heat exchanger, which is arranged below the upstream-side heat exchanger and includes the at least one downstream-side flow path; and at least one merger for merging the refrigerant flowing out of each of the upstream-side flow paths and causing the merged refrigerant to flow into the at least one downstream-side flow path, wherein the upstream-side heat exchanger and the downstream-side heat exchanger are configured separately, the number of the downstream-side flow paths is smaller than the number of the upstream-side flow paths, the upstream-side heat exchanger and the downstream-side heat exchanger each include heat exchange units, each of the heat exchange units includes a plurality of radiator fins arranged in parallel with each other at intervals and allowing passage of air through the intervals, and a plurality of heat transfer tubes penetrating through the plurality of radiator fins in an arrangement direction of the plurality of radiator fins, wherein each of the upstream-side heat exchanger and the downstream-side heat exchanger has the heat exchange units arranged in an air passage direction, such that the heat exchange units of the upstream-side heat exchanger are arranged in a row that extends in the air passage direction, and the heat exchange units of the downstream-side heat exchanger are arranged in a row that extends in the air passage direction, the number of the heat exchange units in the downstream-side heat exchanger is smaller than the number of the heat exchange units in the upstream-side heat exchanger, and a total width of the heat exchange units in the air passage direction in the upstream-side heat exchanger is the same as a total width of the heat exchange units in the air passage direction in the downstream-side heat exchanger.

2. The heat exchanger of claim 1, wherein the number of the heat transfer tubes in the downstream-side heat exchanger is smaller than the number of the heat transfer tubes in the upstream-side heat exchanger.

3. The heat exchanger of claim 2, wherein a fin pitch of the plurality of radiator fins in the downstream-side heat exchanger is smaller than a fin pitch of the plurality of radiator fins in the upstream-side heat exchanger.

4. The heat exchanger of claim 1, wherein widths of the plurality of radiator fins in the air passage direction in the heat exchange units of the downstream-side heat exchanger are uniform.

5. The heat exchanger of claim 1, wherein the number of the heat exchange units in the upstream-side heat exchanger is three, and the number of the heat exchange units in the downstream-side heat exchanger is two.

6. The heat exchanger of claim 1, wherein a facing surface of the upstream-side heat exchanger faces a facing surface of the downstream-side heat exchanger, and each of the facing surfaces is a flat surface extending in the air passage direction.

7. A refrigeration cycle apparatus comprising the heat exchanger of claim 1.

8. The heat exchanger of claim 1, wherein the refrigerant flow paths pass through each of the heat exchange units, and the flow paths passing through a first one of the heat exchange units are connected in series with the flow paths that pass through a second one of the heat exchange units that is located downstream from the first one of the heat exchange units in the air passage direction.

* * * * *